US008865106B2

(12) United States Patent
Way et al.

(10) Patent No.: US 8,865,106 B2
(45) Date of Patent: Oct. 21, 2014

(54) COMPOSITE RAW MATERIAL, CARBON FIBER MATERIAL AND METHOD FOR FORMING THE SAME

(75) Inventors: Tun-Fun Way, Hsinchu (TW); Yu-Ting Chen, Changhua County (TW); Jiun-Jy Chen, Miaoli County (TW); Hsiao-Chuan Chang, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 13/615,460

(22) Filed: Sep. 13, 2012

(65) Prior Publication Data

US 2013/0164207 A1 Jun. 27, 2013

(30) Foreign Application Priority Data

Dec. 26, 2011 (TW) ..... 100148540 A

(51) Int. Cl.
*C01B 31/02* (2006.01)

(52) U.S. Cl.
USPC .... 423/447.1; 524/158; 264/29.2; 423/447.3; 423/460

(58) Field of Classification Search
USPC ..... 423/447.2; 524/158; 264/29.2
See application file for complete search history.

(56) References Cited

U.S. PATENT DOCUMENTS

| | | | | |
|---|---|---|---|---|
| 6,573,373 | B1 | 6/2003 | Shukla et al. | |
| 7,063,870 | B2 | 6/2006 | La Forest et al. | |
| 2004/0057894 | A1 | 3/2004 | Klett et al. | |
| 2008/0227996 | A1 * | 9/2008 | Hara et al. | 558/44 |
| 2008/0251445 | A1 * | 10/2008 | Kamleiter et al. | 210/497.01 |
| 2009/0215953 | A1 | 8/2009 | Hwang et al. | |
| 2010/0317790 | A1 | 12/2010 | Jang et al. | |

FOREIGN PATENT DOCUMENTS

| | | |
|---|---|---|
| CN | 1908021 A | 2/2007 |
| JP | 10036450 | 2/1998 |
| JP | 11124742 | 5/1999 |
| JP | 2008214508 | 9/2008 |
| KR | 100759102 | 9/2007 |
| TW | 200811325 | 3/2008 |
| TW | 201219482 | 5/2012 |

OTHER PUBLICATIONS

English machine translation of JP10-036450 (1998).*
Taiwan Patent Office, Office Action, Patent Application Serial No. 100148540, Oct. 8, 2013, Taiwan.
F. Kucera et al., "Homogeneous and Heterogeneous Sulfonation of Polymers: A Review," Polymer Engineering and Science, May 1998, pp. 783-792, vol. 38, No. 5, Wiley, US.
Weihua Zhou et al., "Sulfonated Carbon Nanotbes/Sulfonated Poly(Ether Sulfone Ether Ketone Ketone) Composites for Polymer Electrolyte membranes," Polymers Advanced Technology. Feb. 2010, pp. 1747-1752, vol. 22, Issue 12, Wiley, US.
Sun Hwa Lee et al., "Tailored Assembly of Carbon Nanotubes and Graphene," Advanced Functional Materials, Apr. 2011, pp. 1338-1354, vol. 21, Issue 8, Wiley, US.
Goki Eda et al., "Chemically Derived Graphene Oxide: Towards Large-Area Thein-Film Electronics and Optoelectronics," Advanced Materials, Jun. 2010, pp. 2392-2415, vol. 22, Issue 22, Wiley, US.

* cited by examiner

*Primary Examiner* — Richard M Rump

(57) ABSTRACT

In one embodiment of the disclosure, a composite raw material and a method for forming the same are provided. The method includes sulfonating a polycyclic aromatic compound to form a polycyclic aromatic carbon sulfonate (PCAS); and mixing the polycyclic aromatic carbon sulfonate and a polyacrylonitrile (PAN) to form a composite raw material. In another embodiment of the disclosure, a carbon fiber containing the composite raw material described above and a method for forming the same are provided.

13 Claims, 1 Drawing Sheet

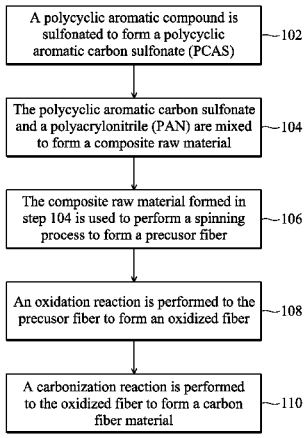

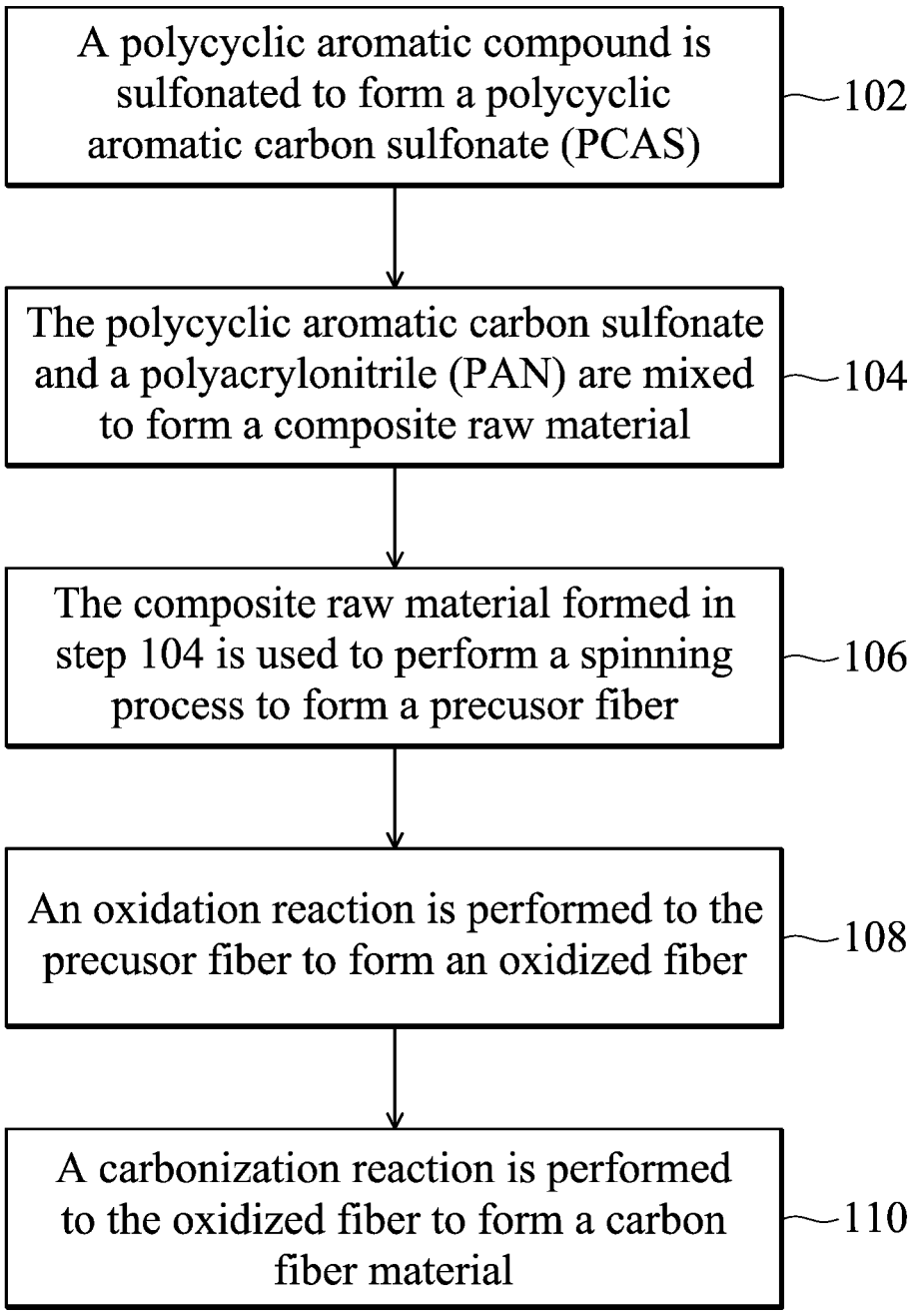
A polycyclic aromatic compound is sulfonated to form a polycyclic aromatic carbon sulfonate (PCAS)
102
The polycyclic aromatic carbon sulfonate and a polyacrylonitrile (PAN) are mixed to form a composite raw material
104
The composite raw material formed in step 104 is used to perform a spinning process to form a precusor fiber
106
An oxidation reaction is performed to the precusor fiber to form an oxidized fiber
108
A carbonization reaction is performed to the oxidized fiber to form a carbon fiber material
110

COMPOSITE RAW MATERIAL, CARBON FIBER MATERIAL AND METHOD FOR FORMING THE SAME

CROSS REFERENCE TO RELATED APPLICATIONS

This Application claims priority of Taiwan Patent Application No. 100148540, filed on Dec. 26, 2011, the entirety of which is incorporated by reference herein.

TECHNICAL FIELD

The technical field relates to a composite raw material, and in particular relates to carbon fiber material made of a composite raw material.

BACKGROUND

Carbon fiber is a good material that has low expansion coefficient, high thermal conductivity, and well stability. Carbon fiber has the characteristic of carbon material and the softness of fiber, and therefore carbon fiber is widely used in various applications such as aircrafts, medicines, architectural structures, and etc. In general, polyacrylonitrile (PAN) carbon fiber is the most commonly used carbon fiber.

Formation of PAN requires oxidation and carbonization processes. During the oxidation process, an acid or base is added to the reaction as a catalyst, such that the oxidation reaction time and reaction temperature can be decreased. That is, the energy consumption and defects in the carbon fiber can be decreased by use of the catalyst. Conventionally, acidic monomer, such as itaconic acid, is copolymerized with PAN material as a catalyst. In other examples, a catalyst, such as a strong acid or a strong base, is added into PAN as an additive such that the oxidation reaction time and reaction temperature can be decreased. However, disadvantages of these catalysts include low boiling point, low thermal resistance, and poor compatibility with PAN. Furthermore, the chemical structure of these catalysts are very different from the oxidized fiber/carbonized fiber, and therefore, when PAN carbon fiber material is formed, these catalysts may become impurities of the carbon fiber and the physical property of the carbon fiber may be negatively affected.

Research has disclosed formation of a composite raw material including PAN and nanotube or graphene. Then, carbon fiber material made of carbon nanotube (CNT)/PAN is formed. In addition, certain research also discloses a composite raw material including PAN and pitch, and the carbon fiber of pitch/PAN is then formed. Advantages of the above described nanotube, graphene, or pitch include high thermal resistance, and therefore tenacity and modulus of the resulting carbon fiber can increase. However, these additives do not have a strong acidic or basic functional group that can serve as a catalyst. Therefore, it is desirable to provide a novel additive having a high boiling point, a high thermal resistance, good compatibility with PAN and a capability to serve as a catalyst.

BRIEF SUMMARY

An embodiment of the disclosure provides a method for manufacturing a composite raw material, including: sulfonating a polycyclic aromatic compound to form a polycyclic aromatic carbon sulfonate (PCAS); and mixing the polycyclic aromatic carbon sulfonate and a polyacrylonitrile (PAN) to form a composite raw material.

Another embodiment of the disclosure provides a composite raw material, including: a polycyclic aromatic carbon sulfonate; and a polyacrylonitrile (PAN).

Another embodiment of the disclosure provides a method for manufacturing carbon fiber material, including: providing the previous described composite raw material; using the composite raw material to perform a spinning process to form a precursor fiber; performing an oxidation reaction to the precursor fiber to form an oxidized fiber; and performing a carbonization reaction to the oxidized fiber to form a carbon fiber material.

Another embodiment of the disclosure provides a carbon fiber material manufactured by the previous described method.

A detailed description is given in the following embodiments with reference to the accompanying drawings.

BRIEF DESCRIPTION OF THE DRAWINGS

The present disclosure can be more fully understood by reading the subsequent detailed description and examples with references made to the accompanying drawings, wherein:

FIG. 1 illustrates a flow chart of manufacturing a carbon fiber material according to one embodiment of the disclosure.

DETAILED DESCRIPTION

The following description is of the best-contemplated mode of carrying out the disclosure. This description is made for the purpose of illustrating the general principles of the disclosure and should not be taken in a limiting sense. The scope of the disclosure is best determined by reference to the appended claims.

In the disclosure, a polycyclic aromatic carbon sulfonate (PCAS) is added to a polyacrylonitrile (PAN) to form a composite raw material, wherein the polycyclic aromatic carbon sulfonate is used as a catalyst during the oxidation and carbonization processes. In addition, carbon fiber material is then made of the composite raw material by a spinning process.

FIG. 1 illustrates a flow chart of forming a carbon fiber material. In step 102, a polycyclic aromatic compound is sulfonated to form a polycyclic aromatic carbon sulfonate (PCAS). In another embodiment, pitch is sulfonated to form a polycyclic aromatic carbon sulfonate. The sulfonating process, for example, may be performed by adding polycyclic aromatic compound into 10% to 30% of fuming sulfuric acid (or sulfuric acid), and the mixture is sonicated at room temperature. Then, the mixture is washed by distilled water and sodium chloride solution respectively for several times, and the mixture is centrifuged to obtain solid precipitate. The solid precipitate is dried in oven to obtain the polycyclic aromatic carbon sulfonate. Furthermore, a molar ratio of sulfur and carbon of the product and the molecular weight determines the sonication time. The shorter the sonication time is, the larger the molecular weight of the polycyclic aromatic carbon sulfonate is, and the smaller molar ratio of sulfur to carbon of the polycyclic aromatic carbon sulfonate is. On the other hand, the longer the sonication time is, the smaller the molecular weight of the polycyclic aromatic carbon sulfonate is, and the larger molar ratio of sulfur to carbon of the polycyclic aromatic carbon sulfonate is. In a preferable embodiment, a molar ratio of sulfur to carbon of the polycyclic aromatic carbon sulfonate is between 1/5 and 1/8. In another preferable embodiment, a molecular weight of the polycyclic aromatic carbon sulfonate is between 100 g/mole and 500 g/mole, more preferably between 100 g/mole and 300 g/mole.

In step 104, the polycyclic aromatic carbon sulfonate and a polyacrylonitrile (PAN) are mixed to form a composite raw material. In one embodiment, a weight ratio of the polycyclic aromatic carbon sulfonate to the polyacrylonitrile is between 2/98 and 3/97.

In step 106, the composite raw material formed in step 104 is used to perform a spinning process to form a precursor fiber. In one embodiment, the spinning process includes a wet spinning process, gel spinning process, or combinations thereof. In step 108, an oxidation reaction is performed to the precursor fiber to form an oxidized fiber. For example, the oxidation reaction is performed in an oxygen containing atmosphere at 190° C. to 270° C. for 1.2 hours to 1.5 hours. Then, a carbonization reaction is performed to the oxidized fiber to form a carbon fiber material, as shown in step 110. The carbonization reaction may be performed in absence of oxygen at 600° C. to 1400° C. for 4 minutes to 5 minutes. The resulting carbon fiber material may have a higher tenacity and modulus than the conventional ones. For example, a tenacity of the carbon fiber material may be between 1 GPa and 2 GPa, and a modulus of the carbon fiber material may be between 180 GPa and 270 GPa.

Compared to carbon fiber material made directly of polyacrylonitrile (PAN), the carbon fiber material made of the composite raw material including polycyclic aromatic carbon sulfonate (PCAS) and PAN has higher tenacity and modulus. In some embodiments, a tenacity of the carbon fiber material increases about 25%, or a modulus of the carbon fiber material increases about 17%.

The PCAS has high boiling point, high heat resistance, and high chemical stability, and thus, it can be a good additive. In addition, after oxidation and carbonization process, the structure of the PAN will be similar to the structure of PCAS. Therefore, when the PCAS is used as an additive, the PCAS will not become an impurity in the resulted product but become a part of the carbon fiber material, such that the property of the carbon fiber material will not be affected.

Moreover, according to the experiments, if a polycyclic aromatic compound or an oxidized polycyclic aromatic compound is added into PAN as an additive, various problems may occur. For example, during the process, a spinneret may be blocked, filament breaking rate may increase, or the additive may be washed out from the fibers. In one embodiment, a molecular weight of the PCAS is between 100 g/mole and 500 g/mole, more preferably between 100 g/mole and 300 g/mole. When the molecular weight of the PCAS is too large, problems such as spinneret blockage or high filament breaking rate may occur. When the molecular weight of the PCAS is too small, the PCAS may be washed out by the solvent during the wet spinning process. Therefore, PCAS with specific molecular weight can not only improve the tenacity and modulus of the resulting carbon fiber material, but also facilitate the spinning process.

Furthermore, in another preferable embodiment, a molar ratio of sulfur to carbon of the polycyclic aromatic carbon sulfonate is between 1/5 and 1/8. According to the experiments, if the molar ratio of sulfur to carbon of the PCAS is too high (in other words, the PCAS contains too many sulfonate groups) the PCAS may be washed out by the solvent during the wet spinning process, resulting in high precipitation rate of the PCAS. Therefore, the coagulation solution may be polluted and the PCAS amount in the PAN fiber may decrease. Therefore, the resulting composite fiber may not reach the desired compositional ratio. On the other hand, if the molar ratio of sulfur to carbon of the PCAS is too small (in other words, the PCAS contains only few sulfonate groups) solubility of the PCAS in the solvent (such as DMSO) may decrease, such that the compatibility of the PCAS and PAN decreases. Therefore, problems such as spinneret blockage or high filament breaking rate may occur. In another embodiment, the amounts of the sulfonate groups in the PCAS may be adjusted to improve the compatibility toward other polymers and/or solvents.

Comparative Example 1

Synthesis of Polyacrylonitrile (PAN)

First, 97.0 wt % of acrylonitrile (AN), 2.5 wt % of methyl acrylate (MA), 0.4 wt % of itaconic acid, 0.1 wt % of 2,2'-azobisisobutyronitrile (AIBN; as an initiator), and 250 mL of dimethylsulfoxide (DMSO; as a solvent) were mixed in a glass reactor. The mixture was stirred for 7 hours at 60° C. to 70° C. Then, water was used to precipitate the product. The precipitated product was then filtered and dried to obtain PAN. Gel permeation chromatography (GPC) was used to analyze the molecular weight of the resulted product, wherein the molecular weight (Mw) of the product was 230,000 g/mole, and the polydispersity index (PDI) was 1.7.

Wet Spinning Process

The resulted PAN was used as a dope (solid content: 25%; solvent: DMSO.) The wet spinning process was performed by a wet spinning machine with a heat jacket. The temperature of the dope was maintained at 70° C. The spinneret had 300 holes, wherein a diameter of each hole was 0.06 mm (L/L=1.2). A length of the coagulation baths was 1,500 cm. A width of the coagulation baths was 20 cm. A depth of the coagulation baths was 40 cm. Three coagulation baths were used in the process. A coagulation solution of the first coagulation bath was water/DMSO (10/90; w/w), and the temperature of the first coagulation bath was set at 5° C. A coagulation solution of the second coagulation bath was water/DMSO (30/70; w/w), and the temperature of the second coagulation bath was set at 70° C. to 85° C. A coagulation solution of the third coagulation bath was water/DMSO (100/0; w/w). A spinning speed of the process was 20 m/min. The resulting fiber was drawn by steam hot drawing (130° C.) and then dried in an oven (80° C.) to obtain a precursor fiber of PAN. A tenacity of the resulting precursor fiber was 3.4 g/den. An elongation of the resulting precursor fiber was 10%.

Oxidation of the Precursor Fiber of PAN

The resulting precursor fiber of PAN was placed in an oxidation reactor to perform a hot-air oxidation reaction. The oxidation reactor was programmed as the following condition: First, the reaction was performed at 190° C. for 0.3 hours. Then, the reaction was performed at 240° C. for 0.6 hours. Finally, the reaction was performed at 270° C. for 0.6 hours. The resulting oxidized fiber had a tenacity of 1.9 g/den, an elongation of 15%, and a density of 1.35 g/cm$^3$.

Carbonization of Oxidized Fiber of PAN

The resulting oxidized fiber of PAN was placed in a carbonization reactor in a $N_2$ atmosphere. First, the reaction was performed at 600° C. to 800° C. Then, the reaction was performed at 1200° C. to 1400° C. The total reaction time from 600° C. to 1400° C. was 5 minutes. The resulting carbonized fiber had a tenacity of 1.6 GPa, an elongation of 0.8%, and a modulus of 230 GPa.

Example 1

Synthesis, Element Analysis, and Spinning Experiment of Polycyclic Aromatic Carbon Sulfonate 2 (PCAS 2)

Synthesis of Polycyclic Aromatic Carbon Sulfonate 2 (PCAS 2)

Polycyclic aromatic carbon sulfonate 1 (PCAS 1) was synthesized according to a method in Japanese patent application NO. 2008214508A (Y. Shinichiro, et. al., Toppan Printing Co.; Tokyo Inst. Tech.)

1 g of the PCAS 1 was added into 20 ml of fuming sulfuric acid (20% $SO_3$/conc. $H_2SO_4$). The mixture was sonicated at room temperature for 0 minute, 3 minutes, 7 minutes, 15 minutes, and 60 minutes respectively. Distilled water was added into each mixture (there were five different mixtures having different sonication time during the formation process) and stirred for 30 minutes. The mixture was centrifuged for 1 hour to obtain the liquid part. 40 ml of the sodium chloride solution (5 wt % $NaCl_{(aq)}$) was added into the liquid and stirred for 10 minutes, such that solid precipitant occurred. Then, the mixture was centrifuged for 1 hour to obtain the solid precipitant. The solid precipitant was washed by 5 wt % of sodium chloride solution and centrifuged to remove the impurity and acid compounds with low molecular weight. The washing process was repeated until the pH value was between 6 and 7. The resulting solid was dried in an ordinary oven at 80° C. for 16 hours. Then, the solid was dried in a vacuum oven at 70° C. for another 24 hours. The PCAS 2 was thus obtained.

The resulting five kinds of PCAS 2 (having different sonication times during the formation process) were analyzed by an Infrared spectrophotometry, showing absorption peaks including: 3100-2100 $cm^{-1}$ (resulting from acid group absorption); 1350 $cm^{-1}$ and 1150 $cm^{-1}$ (resulting from sulfonate group absorption); 800-900 $cm^{-1}$ (resulting from polyaromatic group absorption.) Accordingly, all five PCAS 2 had a sulfonate group and polycyclic aromatic group in their structure.

Element Analysis of the PCAS 2

Molar ratios of sulfur to carbon of the resulting five PCAS 2 were analyzed (as shown in Table 1.) In addition, some PCAS 2 were further analyzed by Matrix-Assisted Laser Desorption/Ionization Time of Flight Mass Spectrometry (MALDI-TOF MS.) The PCAS 2 which were sonicated for 3 minutes and 7 minutes during the formation process had a molecular weight between 100 g/mole and 300 g/mole. The PCAS 2 which were sonicated for 15 minutes and 60 minutes during the formation process had a molecular weight less than 100 g/mole.

Wet Spinning Process of PCAS 2

The PCAS 2 and PAN were mixed in a weight ratio of 3/97 to form a composite raw material as a dope (solid content: 25%; solvent: DMSO.) The wet spinning process was performed by a wet spinning machine with a heat jacket. The temperature of the dope was maintained at 70° C. The spinneret had 300 holes, wherein a diameter of each hole was 0.06 mm (L/L=1.2). A length of the coagulation baths was 1,500 cm. A width of the coagulation baths was 20 cm. A depth of the coagulation baths was 40 cm. Three coagulation baths were used in the process. A coagulation solution of the first coagulation bath was water/DMSO (10/90; w/w), and the temperature of the first coagulation bath was set at 5° C. A coagulation solution of the second coagulation bath was water/DMSO (30/70; w/w), and the temperature of the second coagulation bath was set at 70° C. to 85° C. A coagulation solution of the third coagulation bath was water/DMSO (100/0; w/w). A spinning speed of the process was 20 m/min. The resulting fiber was drawn by steam hot drawing (130° C.) and then dried in an oven (80° C.) to obtain a precursor fiber of the composite raw material containing PCAS 2 and PAN. A tenacity of the resulting precursor fiber of PCAS which were sonicated for 3 minutes and 7 minutes during the formation process were 3.1 g/den and 3.3 g/den respectively. An elongation of the resulting precursor fiber of PCAS 2 which were sonicated for 3 minutes and 7 minutes during the formation process were 9.5% and 10.2% respectively.

TABLE 1

| | Molar ratio of PCAS 2 | | | | |
|---|---|---|---|---|---|
| Sonication time (minute) | 0 | 3 | 7 | 15 | 60 |
| Element analysis (molar ratio of S to C) | <1/10 | 1/7-1/8 | 1/5-1/8 | 1/2-1/4 | >1/2 |

According to the experiments (as shown in Table 1), the PCAS 2 which was not sonicated during the formation process had a molar ratio of sulfur to carbon less than 1/10, and therefore a solubility of the resulting PCAS 2 was poor and a filament breaking rate was high during the wet spinning process. As a result, the PCAS 2 which was not sonicated during the formation process was not suitable for spinning.

The PCAS 2 which was sonicated for 3 minutes during the formation process had a molar ratio of sulfur to carbon between about 1/7 and 1/8. The resulting PCAS 2 was suitable for spinning and the precipitating rate of the PCAS 2 was low. A weight ratio of PCAS 2 to PAN of the resulting fiber was 3/97.

The PCAS 2 which was sonicated for 7 minutes during the formation process had a molar ratio of sulfur to carbon between about 1/5 and 1/8. The resulting PCAS 2 was suitable for spinning and the precipitating rate of the PCAS 2 was low. A weight ratio of PCAS 2 to PAN of the resulting fiber was 3/97.

The PCAS 2 which was sonicated for 15 minutes during the formation process had a molar ratio of sulfur to carbon between about 1/2 and 1/4. The precipitating rate of the PCAS 2 was too high, and therefore a weight ratio of PCAS 2 to PAN of the resulting fiber was 0.7/99.3.

The PCAS 2 which was sonicated for 60 minutes during the formation process had a molar ratio of sulfur to carbon more than 1/2. The precipitating rate of the PCAS 2 was too high, and therefore a weight ratio of PCAS 2 to PAN of the resulting fiber was 0.4/99.6.

Example 2

Synthesis, Element Analysis, and Spinning Experiment of Polycyclic Aromatic Carbon Sulfonate 3 (PCAS 3)

Synthesis of Polycyclic Aromatic Carbon Sulfonate 3 (PCAS 3)

1 g of pitch (brought from China Steel Chemical Corporation) was added into 40 ml of fuming sulfuric acid (20% $SO_3$/conc. $H_2SO_4$). The mixture was sonicated at room temperature for 0 minute, 5 minutes, 17 minutes, 30 minutes, 45 minutes, and 60 minutes respectively. Distilled water was added into each mixture (there were six different mixture having different sonication time during the formation process) and stirred for 30 minutes. The mixture was centrifuged for 1 hour to obtain the liquid part. 40 ml of the sodium chloride solution (5 wt % $NaCl_{(aq)}$) was added into the liquid and stirred for 10 minutes, such that solid precipitant occurred. Then, the mixture was centrifuged for 1 hour to obtain the solid precipitant. The solid precipitant was washed by 5 wt % of sodium chloride solution and centrifuged to remove the impurity and acid compounds with low molecular weight. The washing process was repeated until the pH value was between 6 and 7. The resulting solid was dried in an ordinary oven at 80° C. for 16 hours. Then, the solid was dried in a vacuum oven at 70° C. for another 24 hours. The PCAS 3 was obtained.

The resulting five kinds of PCAS 3 (having different sonication time during the formation process) were analyzed by an Infrared spectrophotometry, showing absorption peaks including: 3500-2900 $cm^{-1}$ (resulting from acid group absorption); 1780 $cm^{-1}$ (resulting from sulfonate group absorption); 800 $cm^{-1}$ (resulting from polyaromatic group absorption.) Accordingly, all six PCAS 3 had sulfonate groups and polycyclic aromatic groups in their structure.

Element Analysis of the PCAS 3

Molar ratios of sulfur to carbon of the resulting six PCAS 6 were analyzed. In addition, some PCAS 3 were further analyzed by Matrix-Assisted Laser Desorption/Ionization Time of Flight Mass Spectrometry (MALDI-TOF MS.) The PCAS 3 which was sonicated for 5 minutes during the formation process had a molecular weight over 600 g/mole. The PCAS 3 which was sonicated for 30 minutes during the formation process had a molecular weight between 100 g/mole and 300 g/mole. The PCAS 3 which was sonicated for 60 minutes during the formation process had a molecular weight less than 100 g/mole.

The PCAS 3 and PAN were mixed in a weight ratio 3/97 to form a composite raw material as a dope (solid content: 25%; solvent: DMSO.) The wet spinning process was performed by a wet spinning machine with a heat jacket. As shown in Table 2, a tenacity of the resulting precursor fiber of PCAS 3 which was sonicated for 30 minutes during the formation process was 3.2 g/den. An elongation of the resulting precursor fiber of PCAS 3 which was sonicated for 30 minutes during the formation process was 10%.

TABLE 2

| | Molar ratio of PCAS 3 | | | | | |
|---|---|---|---|---|---|---|
| | Sonication time (minute) | | | | | |
| | 0 | 5 | 17 | 30 | 45 | 60 |
| Element analysis (molar ratio of S to C) | | <1/10 | 1/9-1/10 | 1/5-1/8 | 1/3-1/4 | 1/2-1/3 |

According to the experiment (as shown in Table 2), the PCAS 3 which was not sonicated during the formation process was not suitable for spinning.

The PCAS 3 which was sonicated for 5 minutes during the formation process had a molar ratio of sulfur to carbon less than 1/10, and therefore a solubility of the resulting PCAS 3 was poor and a filament breaking rate was high during the wet spinning process. As a result, the PCAS 3 which was sonicated for 5 minutes during the formation process was not suitable for spinning.

The PCAS 3 which was sonicated for 17 minutes during the formation process had a molar ratio of sulfur to carbon between about 1/9 and 1/10. A solubility of the resulting PCAS 3 was poor and a filament breaking rate was high during the wet spinning process. As a result, the PCAS 3 which was sonicated for 17 minutes during the formation process was not suitable for spinning.

The PCAS 3 which was sonicated for 30 minutes during the formation process had a molar ratio of sulfur to carbon between about 1/5 and 1/8. The resulted PCAS 3 was suitable for spinning and the precipitating rate of the PCAS 3 was low. A weight ratio of PCAS 3 to PAN of the resulting fiber was 3/97.

The PCAS 3 which was sonicated for 45 minutes during the formation process had a molar ratio of sulfur to carbon between about 1/3 and 1/4. The precipitating rate of the PCAS 3 was too high, and therefore a weight ratio of PCAS 3 to PAN of the resulting fiber was 1.0/99.0.

The PCAS 3 which was sonicated for 60 minutes during the formation process had a molar ratio of sulfur to carbon between about 1/2-1/3. The precipitating rate of the PCAS 3 was too high, and therefore a weight ratio of PCAS 3 to PAN of the resulting fiber was 0.3/99.7.

According to examples 1 and 2, a molar ratio of sulfur to carbon of the polycyclic aromatic carbon sulfonate was preferably between 1/5 and 1/8, or the molecular weight of the polycyclic aromatic carbon sulfonate was preferably between 100 g/mole and 500 g/mole. When the molar ratio of sulfur to carbon of the polycyclic aromatic carbon sulfonate was too small (for example, less than 1/10), and the solubility of the resulting PCAS was poor and a filament breaking rate was high during the wet spinning process. On the other hand, when the molar ratio of sulfur to carbon of the polycyclic aromatic carbon sulfonate was too large (for example, larger than 1/4), there might be too many acid groups in the mixtures or its molecular weight might be too small, such that the solubility of the PCAS 3 was too high, and the PCAS 3 may be washed out in the coagulation bath. The coagulation solution was therefore severely polluted and the PCAS amount in the PAN fiber decreased. Therefore, the resulting composite fiber may not reach a desired compositional ratio.

Example 3

Oxidation of the Precursor Fiber of PCAS 2

The resulting precursor fiber of Example 1 (PCAS 2 which was sonicated for 7 minutes during the formation process) was placed in an oxidation reactor to perform a hot-air oxidation reaction. The oxidation reactor was programmed as the following condition: First, the reaction was performed at 190° C. for 0.3 hours. Then, the reaction was performed at 240° C. for 0.6 hours. Finally, the reaction was performed at 270° C. for 0.6 hours. The resulting oxidized fiber had a tenacity of 2.9 g/den, an elongation of 11%, a density of 1.34 $g/cm^3$, and a limiting oxygen index (LOI) of 61.

Example 4

Oxidation of the Precursor Fiber of PCAS 3

The resulting precursor fiber of Example 2 (PCAS 3 which was sonicated for 30 minutes during the formation process) was placed in an oxidation reactor to perform a hot-air oxidation reaction. The oxidation reactor was programmed as the following condition: First, the reaction was performed at 190° C. for 0.3 hours. Then, the reaction was performed at 240° C. for 0.6 hours. Finally, the reaction was performed at 270° C. for 0.6 hours. The resulting oxidized fiber had a tenacity of 3.1 g/den, an elongation of 9.5%, a density of 1.37 $g/cm^3$, and a limiting oxygen index (LOI) of 64.

Example 5

Carbonization of Oxidized Fiber of PCAS 2

The resulting oxidized fiber of Example 3 was placed in a carbonization reactor in a $N_2$ atmosphere. First, the reaction was performed at 600° C. to 800° C. Then, the reaction was performed at 1200° C. to 1400° C. The total reaction time from 600° C. to 1400° C. was 5 minutes. The resulting carbonized fiber had a tenacity of 1.9 GPa, an elongation of 0.5%, and a modulus of 260 GPa.

Example 6

Carbonization of Oxidized Fiber of PCAS 3

The resulting oxidized fiber of Example 4 was placed in a carbonization reactor in a $N_2$ atmosphere. First, the reaction was performed at 600° C. to 800° C. Then, the reaction was performed at 1200° C. to 1400° C. The total reaction time from 600° C. to 1400° C. was 5 minutes. The resulting carbonized fiber had a tenacity of 2.0 GPa, an elongation of 0.5%, and a modulus of 270 GPa.

According to Examples 5 and 6, when a molar ratio of sulfur to carbon of the polycyclic aromatic carbon sulfonate was between 1/5 and 1/8, or the molecular weight of the polycyclic aromatic carbon sulfonate was between 100 g/mole and 250 g/mole, the composite raw material including the polycyclic aromatic carbon sulfonate and PAN was formed. The composite raw material was then spun, oxidized, and carbonized to form a carbon fiber material. A tenacity of the resulting carbon fiber material increased 25% compared to the conventional PAN carbon fiber in Comparative Example 1. A modulus of the resulting carbon fiber material increased 17% compared to the conventional PAN carbon fiber in Comparative Example 1.

While the disclosure has been described by way of Example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for manufacturing a composite raw material, comprising sulfonating a polycyclic aromatic compound to form a polycyclic aromatic carbon sulfonate (PCAS), wherein a molar ratio of sulfur to carbon of the polycyclic aromatic carbon sulfonate is between 1/5 and 1/8; and mixing the polycyclic aromatic carbon sulfonate and a polyacrylonitrile (PAN) to form a composite raw material.

2. The method for manufacturing a composite raw material as claimed in claim 1, wherein the step of sulfonating comprises using pitch.

3. The method for manufacturing a composite raw material as claimed in claim 1, wherein the step of sulfonating comprises using fuming sulfuric acid, sulfuric acid, or combinations thereof; and the step of sulfonating comprises sonication at room temperature.

4. The method for manufacturing a composite raw material as claimed in claim 1, wherein a molecular weight of the polycyclic aromatic carbon sulfonate is between 100 g/mole and 500 g/mole.

5. The method for manufacturing a composite raw material as claimed in claim 1, wherein a weight ratio of the polycyclic aromatic carbon sulfonate to the polyacrylonitrile is between 2/98 and 3/97.

6. A composite raw material, comprising:

a polycyclic aromatic carbon sulfonate, wherein a molar ratio of sulfur to carbon of the polycyclic aromatic carbon sulfonate is between 1/5 and 1/8; and a polyacrylonitrile (PAN).

7. The composite raw material as claimed in claim 6, wherein a molecular weight of the polycyclic aromatic carbon sulfonate is between 100 g/mole and 500 g/mole.

8. The composite raw material as claimed in claim 6, wherein the polycyclic aromatic carbon sulfonate is formed by sulfonating a polycyclic aromatic compound; and the step of sulfonating comprises sonication at room temperature.

9. The composite raw material as claimed in claim 6, wherein a weight ratio of the polycyclic aromatic carbon sulfonate to the polyacrylonitrile is between 2/98 and 3/97.

10. A method for manufacturing carbon fiber material, comprising:

providing a composite raw material as claimed in claim 6;

using the composite raw material to perform a spinning process to form a precursor fiber;

performing an oxidation reaction to the precursor fiber to form an oxidized fiber; and performing a carbonization reaction to the oxidized fiber to form a carbon fiber material.

11. The method for manufacturing carbon fiber material as claimed in claim 10, wherein the spinning process comprises wet spinning process, gel spinning process, or combinations thereof.

12. The method for manufacturing carbon fiber material as claimed in claim 10, wherein the oxidation reaction is performed in an oxygen containing atmosphere at 190° C. to 270° C. for 1.2 hours to 1.5 hours.

13. The method for manufacturing carbon fiber material as claimed in claim 10, wherein the carbonization reaction is performed in absence of oxygen at 600° C. to 1400° C. for 4 minutes to 5 minutes.

* * * * *